US005295689A

United States Patent [19]

Lundberg

[11] Patent Number: 5,295,689

[45] Date of Patent: Mar. 22, 1994

[54] GOLF CLUB HEAD

[75] Inventor: Harry C. Lundberg, Ramsey, N.J.

[73] Assignee: S2 Golf Inc., Fairfield, N.J.

[21] Appl. No.: 2,708

[22] Filed: Jan. 11, 1993

[51] Int. Cl.[5] ..... A63B 53/04

[52] U.S. Cl. ..... 273/167 H; 273/173

[58] Field of Search ..... 273/167 R, 77 R, 167 H, 273/171, 173, 169, 167 F, 193 R, 194 R, 194 A

[56] References Cited

U.S. PATENT DOCUMENTS

| | | | |
|---|---|---|---|
| D. 314,029 | 1/1991 | Allen . | |
| D. 314,220 | 1/1991 | Allen | D21/214 |
| 1,582,836 | 4/1926 | Link | 273/167 H |
| 1,658,581 | 2/1928 | Tobia . | |
| 1,673,973 | 6/1928 | Drevitson | 273/173 |
| 1,678,637 | 7/1928 | Drevitson | 273/173 X |
| 1,720,867 | 7/1929 | Webster et al. | 273/169 |
| 3,637,218 | 1/1972 | Carlino | 273/168 |
| 3,847,399 | 11/1974 | Raymont | 273/169 X |
| 4,076,254 | 2/1978 | Nygren | 273/173 |
| 4,214,754 | 7/1980 | Zebelean | 273/167 H |
| 4,313,607 | 2/1982 | Thompson | 273/167 |
| 4,438,931 | 3/1984 | Motomiya | 273/167 H |
| 4,461,481 | 7/1984 | Kim | 273/170 |
| 4,535,990 | 8/1985 | Yamada | 273/173 |
| 4,602,787 | 7/1986 | Sugioka et al. | 273/167 H X |
| 4,618,149 | 10/1986 | Maxel | 273/79 |
| 4,635,974 | 1/1987 | Moussaian | 285/305 |
| 4,681,321 | 7/1987 | Chen et al. | 273/167 H |
| 4,730,830 | 3/1988 | Tilley | 273/173 X |
| 4,756,534 | 7/1988 | Thompson | 273/171 |
| 4,811,949 | 3/1989 | Kobayashi | 273/171 |
| 4,815,739 | 3/1989 | Donica | 273/80 |
| 4,852,879 | 8/1989 | Collins | 273/164 |
| 4,919,430 | 4/1990 | Antonious | 273/169 |
| 4,930,781 | 6/1990 | Allen | 273/167 |
| 4,938,470 | 7/1990 | Antonious . | |
| 4,940,236 | 7/1990 | Allen . | |
| 4,944,515 | 7/1990 | Shearer | 273/167 H |
| 4,964,640 | 10/1990 | Nakanishi et al. | 273/167 |
| 4,988,104 | 1/1991 | Shiotani et al. | 273/167 |
| 5,000,454 | 3/1991 | Soda | 273/167 H |
| 5,014,993 | 5/1991 | Antonious | 273/169 |
| 5,054,784 | 10/1991 | Collins | 273/167 |
| 5,060,951 | 10/1991 | Allen | 273/167 |
| 5,125,662 | 6/1992 | Antonious | 273/167 |
| 5,180,166 | 1/1993 | Schmidt et al. | 273/167 H X |

*Primary Examiner*—Vincent Millin
*Assistant Examiner*—Sebastiano Passaniti
*Attorney, Agent, or Firm*—Webb, Burden, Ziesenheim & Webb

[57] ABSTRACT

A golf club head has a pyramid-shaped truss located within an interior of the club head. The truss employs a triangular base placed directly behind a club head striking plate, with a plurality of struts extending from the base to converge at an apex at the tail of the club head. Two of the struts are preferably affixed to an inner side of a club head sole. The struts may be tubular or solid. The truss prevents distortion of the club head at head-ball impact, and also reduces the tendency of the club head to twist about its center of gravity when contact is made with the ball. The truss is particularly applicable to hollow, metal "wood" club heads, which typically must be designed with thinner striking plates. The truss also facilitates manufacture of composite graphite club heads by inexpensive injection molding techniques without compromising club head strength.

25 Claims, 2 Drawing Sheets

GOLF CLUB HEAD

BACKGROUND OF THE INVENTION

1. Field of the Invention

The present invention relates to wood and iron golf clubs and, more particularly, to means for reinforcing wood and iron golf club heads.

2. Description of the Prior Art

It is understood by those in the art that the term "woods" pertains to a family of golf clubs having shafts of longer length, used primarily for tee and fairway shots where considerable distance is the object. "Iron" clubs are those of shorter length, generally employed for shorter distances. For various reasons, woods with club heads made of wood materials are being superceded by heads made of metal or of composite graphite or other materials. Metallic heads are usually hollow in construction, to produce a head with volume large enough for practical use. Because the density of metallic materials is so high, solid club heads of adequate volume are prohibitively heavy. While most composite graphite club heads to date have been of solid construction, recent designs for these club heads have also incorporated hollow interiors. In any case, composite graphite heads generally include separately attached sole plates, usually made of steel, aluminum or brass.

In the case of iron club heads, these club heads have traditionally been solid. However, hollow iron club heads have been available for about two decades.

Hollow woods and irons have met with several difficulties. In many cases, the striking faces of the heads can not withstand impact forces over time, resulting in denting or face collapse. In other cases, the club head distorts excessively during impact with the ball, due to compressive forces. In the case of hollow club heads employing thicker club faces, concentration of club head weight at the face necessitates making the rest of the club head with thinner walls to keep the club head at the desired weight. Crumpling and fracturing of these thinner wall surfaces has occurred at undesirable rates.

Injection molded composite graphite heads have tended to be too soft for the application, yielding a poor energy transfer from head to ball. Harder material inserts, located in the striking face at the impact zone, have been a general remedy, but overall head distortion during head-ball collisions is still high. Compression molded composite graphite solid heads have tended to resist impact forces well, but the comparative cost of compression molded heads is too high.

The prior art has sought to overcome these difficulties with several remedies, including attempted reinforcement of head faces on the interior of the face wall to resist face collapse. See, for example, U.S. Pat. Nos. 3,847,399 and 4,930,781.

U.S. Pat. Nos. 4,076,254; 5,000,454; 4,535,990; 4,313,607; 4,756,534, 4,681,321; and 1,658,581 generally disclose a support member in the club head interior extending from the interior side of the club striking face to the rear of the club. Other designs utilize special alloys, including cobalt, to improve club head strength. None of the above utilize the structural properties of triangulation to advantageously resist deformation and enlarge the sweet spot of the striking face.

Thus, it is an object of the present invention to increase mechanical stiffness and strength in the golf club head so that the head will resist deformation at impact with a golf ball. It is a further object to provide added mechanical strength to the striking face of the club, so that the face thickness can be safely reduced. It is a still further object to reduce face wall thickness to liberate a finite amount of weight which can then be added to other portions of the club head to serve other design criteria, such as relocating the center of gravity to more optimum locations. It is a still further object to provide resistance to twisting of the club head at impact with the ball to reduce deviation of the ball from the intended target line. With respect to composite graphite heads, it is an object of the invention to enable use of relatively inexpensive injection molding to form the heads without compromising head strength. Finally, it is an object of the present invention to enlarge the "sweet spot" hitting zone of the striking face.

SUMMARY OF THE INVENTION

Accordingly, I have invented a golf club head having a striking plate with an outer side and an interior side and a tail spaced from the interior side of the striking plate. A sole extends between the striking plate and the tail, and a plurality of struts engage the interior side of the striking plate and extend toward the tail. The struts converge to form an apex adjacent the tail of the club head.

Preferably, the struts are interconnected at the interior side of the striking plate by a plurality of base rods. The base rods define a support cell directly behind the striking plate, which may be in the shape of a polygon.

Most preferably, the base rods define an equilateral triangle so that the base rods in cooperation with the struts form a triangular, pyramid-shaped truss, also known as a "Modified Fink Truss". When the truss is constructed within a golf club head, a pyramid base engages the interior side of the striking plate with a pyramid point adjacent the tail. The truss employs the properties of triangulation to resist deformation and distortion of the striking plate.

Other features and advantages of the present invention will become apparent from the following detailed description in conjunction with the accompanying drawings.

DETAILED DESCRIPTION OF THE PREFERRED EMBODIMENTS

Figure 1:
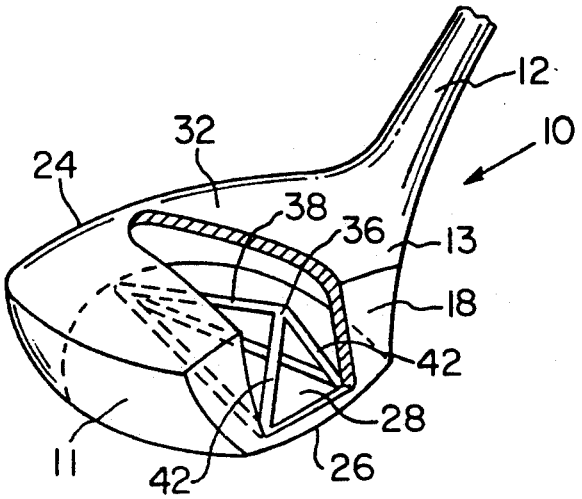
FIG. 1 is a perspective view, partially broken away, of a wood golf club having a hollow head with a pyramid truss according to the present invention located therein.
Figure 2:
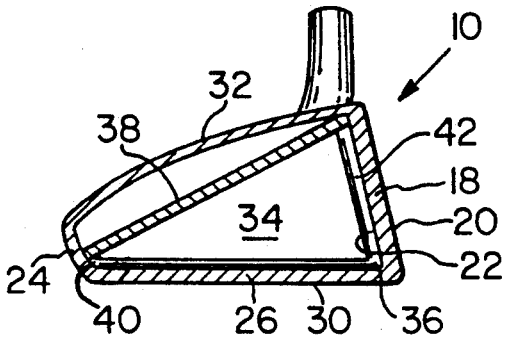
FIG. 2 is a sectional view taken along lines 2—2 of FIG. 1.
Figure 3:
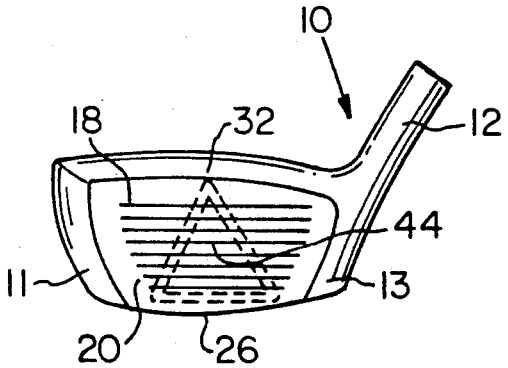
FIG. 3 is a front view of a club head showing in phantom a truss according to the present invention positioned behind the striking plate of the club.
Figure 4:
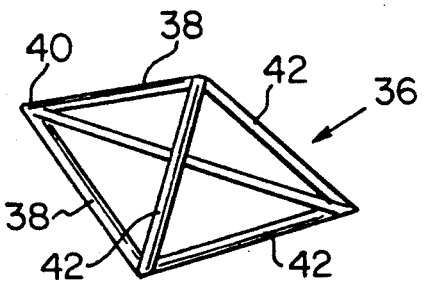
FIG. 4 is a perspective view showing a truss according to the present invention.

FIGS. 1-3 show a wood club head 10 incorporating the present invention. Club head 10 has a hosel 12 which receives a shaft 14. The club head also has a toe 11 spaced from the hosel 12 and a heel 13 adjacent hosel 12. A grip 16 is located on an end of the shaft opposite club head 10 for grasping by the golfer.

Particularly, club head 10 has a striking plate 18 having an outer side or "face" 20 and an interior side 22. Club head 10 also has a tail 24 spaced from the interior side 22 of striking plate 18, and a sole 26 having an inner side 28 and an outer side 30, extends between striking plate 18 and tail 24. A top cover 32 extends above sole 26, and the top cover, sole, striking plate and tail cooperate to define a hollow interior 34 for club head 10.

According to the invention, a pyramid-shaped truss 36 or "Modified Fink Truss" is disposed within hollow interior 34. Truss 36 includes three struts 38 which engage the interior side 22 of striking plate 18 and extend toward tail 24. At least two of the struts 38, and preferably all three, converge to form an apex 40 adjacent tail 24. The apex 40 may be either blunt or pointed and preferably engages tail 24.

The truss 36 also includes three base rods 42 which engage the interior side 22 of face plate 18. The base rods interconnect the struts 38 at their points of engagement with striking plate 18 to define a support cell 44 behind the striking plate. The base rods are preferably fixed to the interior side 22 of the striking plate, such as by welding. It is generally preferred that the support cell 44 is in the shape of a polygon, most preferably an equilateral triangle. However, in some applications the support cell may be circular or otherwise. The struts 38 and base rods 42 cooperate to define the truss 36. The base rods 42 define a pyramid base while the apex 40 defines a pyramid point adjacent the tail 24.

The struts 38 and base rods 42 may be tubular or they may be solid, depending on the type of materials used to form the club head 10, the shape and design of the club head and the thicknesses of the various club head walls 18, 24, 26, 32. Preferably, two of the struts 38 are engaged on the inner side 28 of sole 26, such as by welding. This provides added support and rigidity to the striking plate 18.

Figure 5:
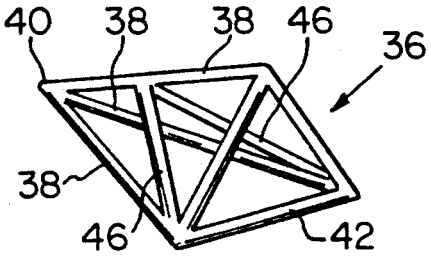
FIG. 5 is a perspective view of the truss of FIG. 4, including a pair of interior brace members.

A second embodiment of the truss 36 is shown in FIG. 5. This truss includes two interior brace members 46, each extending between two struts 38 intermediate the striking plate 18 and the tail 24. Preferably, the interior brace members 46 extend from the two struts 38 which are adjacent the sole 26 at their points of engagement with the striking plate 18 upward to the third strut 38 intermediate its point of engagement with striking plate 18 and the tail 24. This truss design is useful in club heads requiring thinner walls, such as "jumbo" wood club heads, which are oversized. This provides support for striking plate 18 while maintaining proper club head weight. Striking plate 18 can thus be thinner to accommodate jumbo club head design criteria.

To assemble club heads having a truss 36 of the present invention, the struts and base rods are welded, first to the walls 18, 24, 26, 32 at their respective interior locations and then to one another during final assembly of the head. For heads made of composite graphite, the truss 36 will first be completely assembled and firmly attached to the inner side 28 of sole 26. It is anticipated that the composite graphite head would then be molded about this structure to ensure firm bracing of the several walls 18, 24, 26 and 32. The truss facilitates using relatively inexpensive injection molding to accomplish this objective. As described below, the truss adds structural strength to the club head heretofore unobtainable with injection molding.

Figure 6:
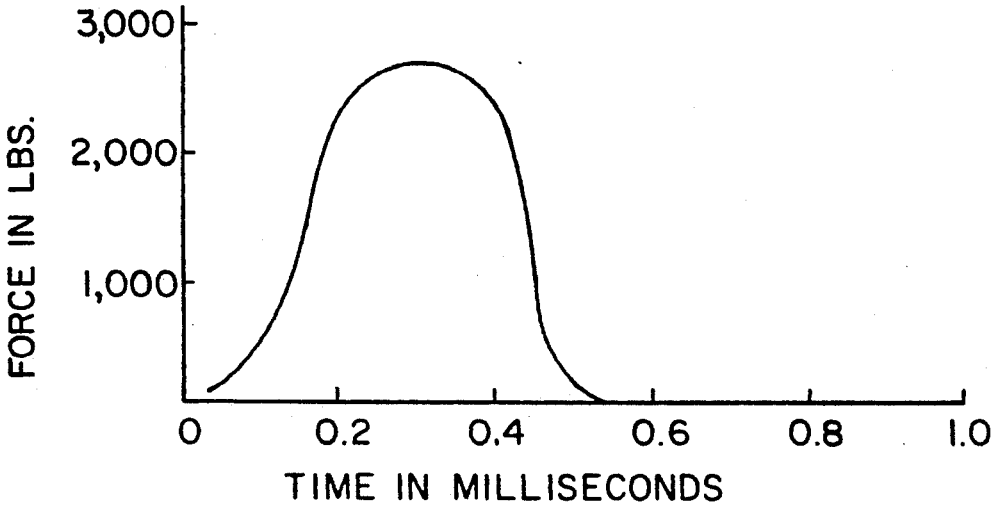
FIG. 6 is a graphic illustration of force versus time for the impact of a wood club head, particularly a "driver", with a golf ball at club head speed of 100 mph.
Figure 7:
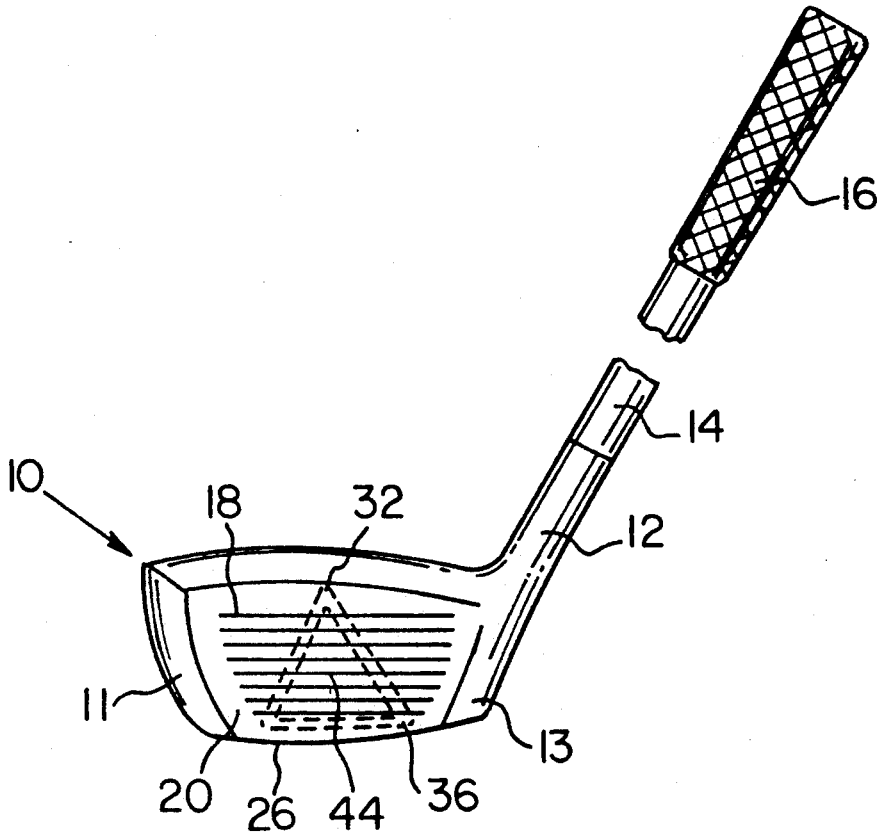
FIG. 7 is a front elevation view of a golf club having a club head according to the present invention.

FIG. 6 illustrates the variation of force with time between a driver club head and a golf ball. The driver is used to hit the ball the greatest distance possible by the golfer. The force may be measured at varying club head speeds through transducers wired to three club head locations. The measurements may be recorded on an oscilloscope. To confirm the measurements, the force may be calculated utilizing the following formula:

$$\text{Force} = \frac{\text{Mass} \times \text{Initial Ball Velocity}}{\text{Time Interval}}$$

Mass of Ball = 1.6 oz. = .003 slug
Recorded Velocity = 260 ft. per second
Time = .0003 seconds $$F = \frac{.003 \times 260}{.0003}$$

$$F = 2600 \text{ pounds}$$

Thus, the force transmitted to a golf ball by a stronger golfer is on the order of 2600 pounds. By Newton's Third Law, the club head 10 receives the same magnitude of force from the ball. Club heads for drivers typically weigh between 7 and 7½ ounces. If the striking plate 18 is made of stainless steel, for example "431" or "17-4", the striking plate must be sufficiently thick or it will collapse. These forces on impact may also compress the entire club head 10, producing an inefficient energy transfer from head to ball. The total time during collision is so short that the deformed head cannot restore its shape before the ball is already in flight. Off center hits exacerbate these problems. The club head will twist around its center of gravity and the ball will then be directed off the target line due in part to the well-known gear effect.

The truss 36 of the present invention employs the structural properties of triangulation to resist this deformation and distortion. In the case of club to ball contact in the center of striking plate 18, the triangular pyramid formed by the struts 38 extending from behind striking plate 18 to the tail 24, will brace against the forces discussed above. In the case of toe 11 or heel 13 hits, the truss 36 will retard distortion and twisting due to the fact that the base rods 42, which define support cell 44, support the interior side 22 of striking plate 18 and enlarge the "sweet spot" hitting zone of the striking plate. Forces applied to the striking plate are thus transmitted through struts 38 to the rear of club head 10 at the apex 40.

The truss 36 resists deformation and distortion of the striking plate 18, maximizing the efficiency of energy transfer from club head 10 to the golf ball and minimizing problems related to off center hits on the striking plate.

Having described the presently preferred embodiments of the invention, it will be understood that it is not intended to limit the invention except within the scope of the following claims.

I claim:

1. A golf club head, comprising:

a striking plate having an outer side and an interior side;

a tail spaced from the interior side of said striking plate;

a sole extending between said striking plate and said tail;

a top cover disposed opposite said sole and extending between said striking plate and said tail; and a plurality of struts engaging the interior side of said striking plate and extending toward said tail, at least two of said struts converging to form a point adjacent the tail of the club head.

2. The golf club head of claim 1 wherein said struts are interconnected by a plurality of base rods, said base rods defining a support cell directly behind said striking plate.

3. The golf club head of claim 2 wherein said base rods define a polygonal support cell.

4. The golf club head of claim 2 wherein said struts in cooperation with said base rods define a triangular pyramid truss having a pyramid base engaging the interior side of said striking plate with a pyramid point adjacent said tail.

5. The golf club head of claim 3 wherein said base rods define an equilateral triangle.

6. The golf club head of claim 1 including three struts.

7. The golf club head of claim 1 wherein at least two struts are affixed to an inner side of said sole.

8. The golf club head of claim 1 wherein said struts engage the tail at said point.

9. The golf club head of claim 1 wherein said struts are tubular.

10. The golf club head of claim 1 wherein all said struts converge at said point.

11. The golf club head of claim 1 including at least one interior brace member extending between two of said struts intermediate said striking plate and said tail.

12. A golf club head, comprising:

a striking plate with an outer side and an interior side;

a tail spaced from the interior side of said striking plate;

a sole extending between said striking plate and said tail;

a top cover disposed opposite said sole and extending between said striking plate and said tail;

a plurality of struts engaging the interior side of said striking plate and extending toward said tail, said struts converging to form an apex adjacent the tail of the club head; and a plurality of base rods engaging the interior side of said striking plate and interconnecting said struts to define a support cell directly behind said striking plate.

13. The golf club head of claim 12 including three struts.

14. The golf club head of claim 13 wherein said base rods define an equilateral triangle.

15. The golf club head of claim 12 wherein at least two struts are affixed to an inner side of said sole.

16. The golf club head of claim 12 wherein said struts and said base rods are tubular.

17. The golf club head of claim 12 including at least one interior brace member extending between two of said struts intermediate said striking plate and said tail.

18. The golf club head of claim 12 wherein said struts in cooperation with said base rods define a triangular pyramid truss having a pyramid base engaging the interior side of said striking plate with a pyramid point adjacent said tail.

19. A golf club, comprising:

an elongated shaft having a grip end and a lower end;

a head having a hosel, the lower end of said shaft disposed in said hosel;

a striking plate on said head, said striking plate having an outer side and an interior side;

a tail spaced from the interior side of said striking plate;

a sole having an inner side extending between said striking plate and said tail;

a top cover disposed opposite said sole and extending between said striking plate and said tail;

at least three struts engaging the interior side of said striking plate and extending toward said tail, two of said struts affixed to the inner side of said sole, all of said struts converging to form an apex adjacent said tail; and a plurality of base rods interconnecting said struts and defining a support cell in the shape of an equilateral triangle directly behind said striking plate;

wherein said struts and said base rods cooperate to define a triangular pyramid truss for supporting said striking plate on impact with a golf ball.

20. A golf club head, comprising:

a striking plate having an outer side and an interior side;

a tail spaced from the interior side of said striking plate;

a sole extending between said striking plate and said tail;

a top cover disposed opposite said sole and extending from said striking plate to said tail; and a plurality of struts engaging the interior side of said striking plate and extending toward said tail, at least two of said struts converging to form an apex adjacent the tail of the club head;

said struts interconnected by a plurality of base rods, said base rods defining a support cell directly behind said striking plate.

21. The golf club head of claim 20 wherein said base rods define a polygonal support cell.

22. The golf club head of claim 21 wherein said base rods define an equilateral triangle.

23. A golf club head, comprising:

a striking plate having an outer side and an interior side;

a tail spaced from the interior side of said striking plate;

a sole extending between said striking plate and said tail;

a top cover disposed opposite said sole and extending from said striking plate and said tail; and a plurality of struts engaging the interior side of said striking plate and extending toward said tail, at least two of said struts converging to form an apex adjacent the tail of the club head;

wherein at least two struts are affixed to an inner side of said sole.

24. A golf club head, comprising:

a striking plate having an outer side and an interior side;

a tail spaced from the interior side of said striking plate;

a sole extending between said striking plate and said tail;

a top cover disposed opposite said sole and extending between said striking plate and said tail;

a plurality of struts engaging the interior side of said striking plate and extending toward said tail, at least two of said struts converging to form an apex adjacent the tail of the club head; and at least one interior brace member extending between two of said struts intermediate said striking plate and said tail.

25. The golf club head of claim 20 wherein said struts in cooperation with said base rods define a triangular pyramid truss having a pyramid base engaging the interior side of said striking plate with a pyramid point adjacent said tail.

* * * * *

UNITED STATES PATENT AND TRADEMARK OFFICE

CERTIFICATE OF CORRECTION

PATENT NO. : 5,295,689

DATED : March 22, 1994

INVENTOR(S) : Harry C. Lundberg

It is certified that error appears in the above-indentified patent and that said Letters Patent is hereby corrected as shown below:

Claim 23 Line 55 Column 6 "plate and" should read --plate to--.

Claim 24 Line 2 Column 7 "between" should read --from--.

Claim 24 Line 2 Column 7 "and" should read --to--.

Signed and Sealed this

Twenty-sixth Day of July, 1994

*Attest:*

Bruce Lehman

BRUCE LEHMAN

*Attesting Officer*

*Commissioner of Patents and Trademarks*